US011510478B1

(12) United States Patent
Aspland et al.

(10) Patent No.: US 11,510,478 B1
(45) Date of Patent: Nov. 29, 2022

(54) SKIN LOTION DISPENSER

(71) Applicants: Kelli Jayne Aspland, St Dials (GB); Laura Jayne Griffin, Gloucestershire (GB)

(72) Inventors: Kelli Jayne Aspland, St Dials (GB); Laura Jayne Griffin, Gloucestershire (GB)

( * ) Notice: Subject to any disclaimer, the term of this patent is extended or adjusted under 35 U.S.C. 154(b) by 0 days.

(21) Appl. No.: 17/384,927

(22) Filed: Jul. 26, 2021

(51) Int. Cl.
*A45D 34/04* (2006.01)
*A45D 40/26* (2006.01)
*B05C 17/02* (2006.01)

(52) U.S. Cl.
CPC ..... *A45D 34/041* (2013.01); *A45D 40/261* (2013.01); *A45D 2200/054* (2013.01); *A45D 2200/1018* (2013.01); *B05C 17/02* (2013.01); *B05C 17/0205* (2013.01); *B05C 17/0235* (2013.01)

(58) Field of Classification Search
CPC ..... A45D 34/041; A45D 2200/054; A45D 2200/1018; A45D 40/261; B05C 217/005; B05C 17/02; B05C 17/0205; B05C 17/0235
USPC ..... 401/6, 7, 208, 209, 213, 216, 183–185
See application file for complete search history.

(56) References Cited

U.S. PATENT DOCUMENTS 2,837,756 A * 6/1958 Barlow ..... B65D 47/42 401/214
6,010,264 A * 1/2000 Scuderi ..... A45D 34/041 401/209
6,095,708 A * 8/2000 Butaud ..... A45D 34/041 401/209
6,925,672 B1 * 8/2005 Bromley ..... A61H 15/02 15/210.1
9,918,593 B2 * 3/2018 LeBlanc ..... A47K 7/03

* cited by examiner

*Primary Examiner* — David J Walczak
(74) *Attorney, Agent, or Firm* — RC Trademark Company

(57) ABSTRACT

A refillable skin lotion dispenser includes a refillable lotion housing having an openable collar located at or adjacent a first end thereof. The collar includes a dispensing valve configured to dispense lotion therethrough under gravity; and an annular sponge permanently secured to the collar and configured to surround the dispensing valve so as to be operative to spread dispensed lotion over an area of skin.

16 Claims, 2 Drawing Sheets

SKIN LOTION DISPENSER

This invention relates to refillable lotion dispensers, such as those dispensers typically used to dispense sun screen lotions over selected areas of skin.

BACKGROUND OF INVENTION

Conventional lotions, such as for example sunscreen lotions, lotions, gels, are typically provided in containers which include a number of weeks worth of applications. These containers can be cumbersome and heavy to carry, especially for younger persons.

A lotion dispenser is disclosed in WO2014152679 which comprises a rigid housing for receiving a resilient liner adapted to hold liquid such as sun screen lotion. The lotion is dispensed from the liner by means of an actuator, such as by means of a moveable actuator acting as a pump to deliver quantities of the lotion to a resilient applicator sponge pad whereafter the lotion can be evenly spread over the skin's surface. The apparatus can be replenished with lotion once the liner has been emptied and is readily portable, although it will be appreciated that the use of a liner and associated moveable actuator collectively constitute a relatively complicated mechanism for storing and dispensing a required quantity of lotion. In addition, the liner itself is of the lay flat plastics type and hence the housing for the liner is of generally similar configuration, as is also the resilient applicator pad, being generally elongate and of width corresponding to the width of the housing and associated collapsible liner. A similarly shaped and sized closure cap fits over the applicator pad when the applicator is not in use. Whilst such an arrangement is generally satisfactory the number and type of component parts increase the cost of manufacture as compared to, say, a squeezable resilient container having an openable end surrounded by a sponge pad of the type popular for dispensing shoe polish.

There is a need for a refillable lotion dispenser which can be used by a person to effectively and reliably apply lotion, such as for example sun screen lotion, to their skin without requiring additional support. There is also a need for a refillable lotion dispenser which can be used by a person single handedly to effectively and reliably apply lotion, such as for example sun screen lotion, to their skin without requiring additional support.

SUMMARY OF INVENTION

The present invention is derived from the realisation that there is a need for a simpler method of ensuring that younger children (e.g. school children) and persons with mobility and/or sensory issues have daily access to lotions such as sun screen lotion while at school with access to a dispenser that is largely unobtrusive and can be easily replenished from day to day.

According to a first aspect of the present invention there is provided a refillable skin lotion dispenser comprising:

a refillable lotion housing having an openable collar located at or adjacent a first so end thereof, the collar comprising:

a dispensing valve configured to dispense lotion therethrough under gravity; and an annular sponge permanently secured to the collar and configured to surround the dispensing valve so as to be operative to spread dispensed lotion over an area of skin.

According to a second aspect of the present invention there is provided a method for manufacturing a refillable skin lotion dispenser comprising:

permanently securing an annular sponge to an openable collar comprising a dispensing valve, such that the annular sponge surrounds the dispensing valve; and releasably mounting an openable collar comprising a dispensing valve on a first end of the refillable lotion housing;

The skin lotion may include, for example, lotions, gels, sunscreens, or any combination thereof.

The refillable lotion housing preferably defines an internal cavity configured to receive lotion.

The refillable lotion housing, and in particular the cavity of the refillable lotion housing, may be sized to receive a predetermined volume of lotion. For example, the refillable lotion housing, for example the cavity, may be sized to receive a volume of lotion intended to be used within a single day.

With this arrangement the dispenser can be made relatively small as compared to a normal sized dispenser or container having a supply of several weeks or several months of lotion. In one embodiment, the skin lotion dispenser may be small enough to fit easily within a pocket or handbag. The refillable skin lotion dispenser of the present invention is therefore more transportable (i.e. smaller and lighter) than conventional dispensers.

The openable collar of the housing enables the user to clean and refill the lotion dispenser frequently, for example every day, such that the user of the dispenser has a ready supply of (e.g. sun screen) lotion without the need to carry an excessive supply of such lotion in a larger, heavier container.

The openable collar may be attached to the refillable lotion housing by any suitable releasable engagement means, such as for example by threaded engagement, push fit engagement, snap fit engagement, or any combination thereof.

The openable collar may be hingeably connected to the refillable lotion housing.

The openable collar is preferably composed of plastic, for example polypropylene.

The housing, preferably the collar, is preferably ergonomically shaped, such that the dispenser can be held in one hand with ease and comfort.

The dispensing valve is preferably substantially centrally located between opposing surfaces of the housing.

The dispensing valve is preferably a roller ball and associated part-spherical roller ball capture seat, allowing for rotation of the ball as it is rolled over an area of skin during which lotion is dispensed under gravity from the cavity of the housing, onto the roller ball, and deposited onto the skin, being spread therearound, easily and effectively by the annular sponge.

The annular sponge preferably substantially surrounds, for example extends around the entire periphery of, the dispensing valve. It is however to be understood that in some embodiments, the annular sponge may consist of a plurality of spaced apart sponge portions located adjacent, and optionally spaced apart from, additional sponge portions, to provide in effect an annular sponge.

The sponge is permanently secured to the collar to provide improved sponge-to-skin contact during dispensing and application of lotion to the skin. Improved sponge-to-skin contact is important in order to ensure efficient and effective lotion application.

The sponge has a first end configured to be located at or adjacent, and permanently fixed to, the collar and a second opposed free end providing an application surface.

The location and orientation of the second opposed free end, and in particular of the application surface, relative to the collar is important to ensure a smooth, even and efficient application of the lotion to the skin of the user.

By ensuring that the sponge is permanently secured to the collar, the orientation of the second opposed free end, providing the application surface, is maintained in an optimal position for lotion application relative to the collar for each and every application. This provides reassurance that the dispenser can be used time and again with reliable efficiency at applying the lotion.

By providing the sponge in a permanently fixed orientation relative to the collar and dispensing valve, it has been found that an easier, more effective and accurate application of the lotion can be achieved, each and every time over the lifespan of the dispenser, due to the guaranteed location and orientation of the second free end of the sponge.

The sponge is preferably an open cell sponge.

The sponge is permanently secured to the collar to prevent deterioration of for example releasable fixations provided at a first end of the sponge, over time and repeated use, and by exposure to the lotion, in particular by ingredients within the lotion, such as for example alcohol.

The refillable skin lotion dispenser has a minimal or minimum number of separable parts, for example the housing and the collar, thereby reducing the risk of parts becoming separated or broken during use and storage.

The lotion dispenser of the present invention does not require any complex assembly of parts, in particular does not require mounting of a sponge on the collar prior to use, in order to be used. Permanent attachment of the sponge to the collar removes the risk of user error during assembly of the dispenser, which could lead to suboptimal lotion application, and varying qualities (such as smoothness, efficiency and evenness) between various applications. As a result, the refillable skin lotion dispenser can be effectively used to apply lotion by person having mobility or dexterity issues, such as for example arthritis. Furthermore, the lotion dispenser with minimal assembly requirements prior to dispensing of lotion, enables young child to independently apply the lotion to their own skin with improved ease, efficiency and accuracy.

The permanently secured sponge enables the lotion to be evenly applied to the skin making the process of applying the lotion easier for persons with sensory issues. In particular, the permanent fixation of the sponge to the collar removes the requirement for an individual to remove the used, excess lotion covered sponge from the collar after use, and to reinstall prior to the next use. As such, the lotion dispenser of the present invention is mess-free and as such is easier for persons with sensory issues to use.

The refillable skin lotion dispenser, and in particular the permanently secured annular sponge, therefore provides a more reliable, accurate, mess-free and effective means for ensuring lotion is evenly applied to the skin of a user compared to conventional lotion dispensers.

The refillable skin lotion dispenser is prepared by a simplified assembly and manufacturing process compared to conventional lotion dispensers.

The sponge may be permanently secured to the collar by means of any suitable permanent fixation means. Preferably, the permanent fixation means is not susceptible to degradation by components within the lotion, for example by alcohol or alcohol based components, over time. For example, the sponge may be permanently secured to the collar by means of adhesive, such as for example hot glue. The collar may comprise a mounting portion configured to receive a first end of the annular sponge for permanent engagement. In one embodiment, adhesive (such as for example hot adhesive) may be deposited on the mounting portion to permanently secure the first end of the annular sponge to the collar.

The permanent fixation, for example using adhesive (for example an ethyl vinyl acetate adhesive, such as for example a hot glue, such as for example Tecbond 261), of the annular sponge ensures that the annular sponge is held securely in position, during repeated use, without becoming loose or detached due to frictional application forces, thereby ensuring optimal application of the lotion during repeated use of the dispenser.

The dispenser preferably includes a valve closure cap releasably mounted on the collar.

The valve closure cap may for example be releasably mounted by means of an interference fit. The valve closure cap may for example be releasably mounted through the use of a circular bead around the rim of the collar being receivable within a correspondingly shaped circular groove around the edge of the closure cap, or vice versa.

The valve closure cap may for example be releasably mounted by screw threaded engagement.

In a refinement to this concept the closure cap itself may also be mountable in the same way on the housing, thereby forming, in essence, an extension to the housing for the purposes of providing a handle with which the dispenser may be easily operated by a user thereof.

The valve closure cap may be shaped to enable the refillable lotion housing to be stored in a preferred or optimal position for lotion dispensing. For example, the valve closure cap may also include a flattened end region by which the cap and hence the housing and associated collar may be stored upright on a flat surface, such as a desk. For example, the dispenser may be stored, using the valve closure cap, such that the housing rests immediately above the dispensing valve. When required, the lotion may dispensed onto the skin of a user after removal of the closure cap.

The refillable lotion housing has a second opposed end which is preferably ergonomically shaped to be held by a single hand of a user such that the collar is moveable relative to the skin of a user. The refillable skin lotion dispenser may therefore be configured for single-handed application to the skin of a user's body.

In one embodiment, the second end of the housing is shaped to be received within, and to contact, the palm of a hand of a user such that the fingers extend across the second end and are received within a recess located between the first and second ends of the housing.

The invention will now be described, by way of example only, with reference to the accompanying drawings in which:

DETAILED DESCRIPTION

Figure 1:
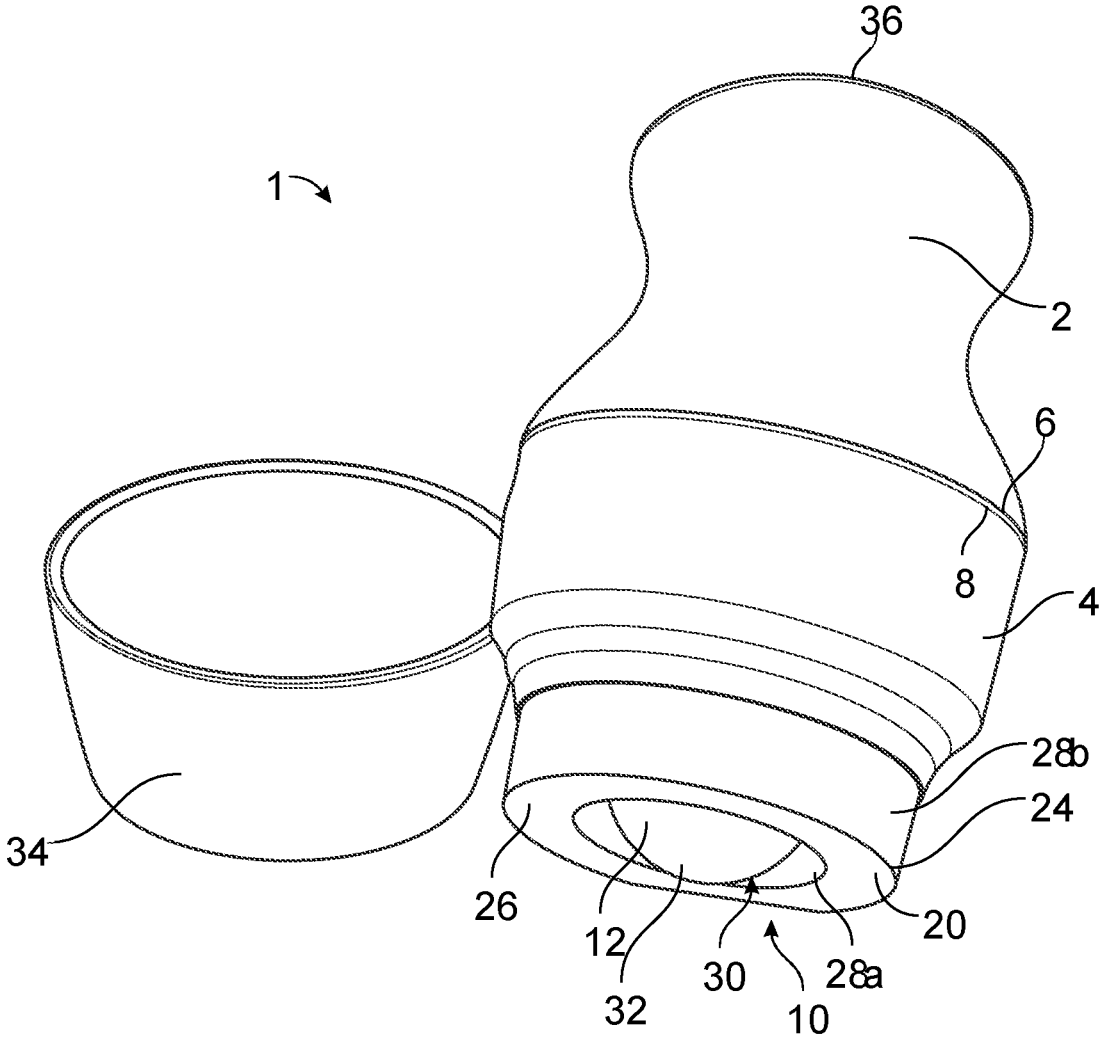
FIG. 1 is a perspective view of a refillable skin lotion dispenser according to one embodiment of the present invention.
Figure 2:
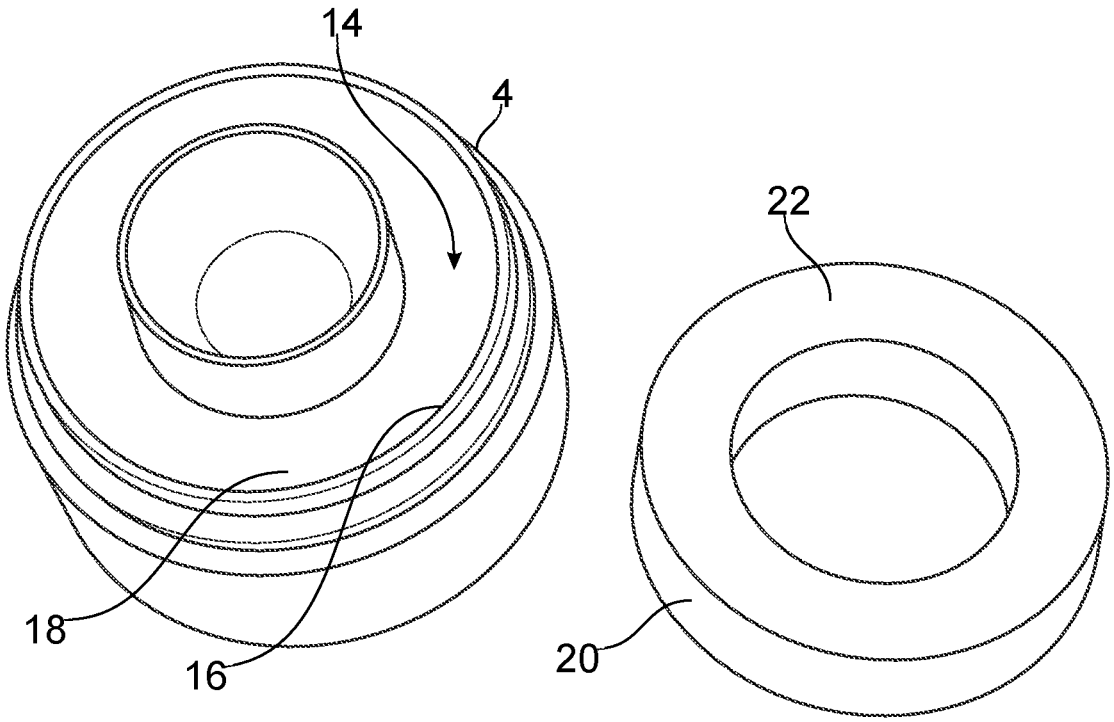
FIG. 2 is a view from above of the openable collar, dispensing valve and annular sponge of the refillable skin lotion dispenser of FIG. 1.

With reference to FIG. 1 and FIG. 2, the refillable skin lotion dispenser 1 comprises a refillable lotion housing 2 having an openable collar 4 located at a first end 6 thereof.

The housing is composed of polypropylene. It is however to be understood that the housing may be composed of any suitable materials, such as for example other polymeric materials/mixtures thereof and/or non-polymeric materials (such as for example eco friendly materials).

The refillable lotion housing 2 defines an internal cavity (not shown) configured to receive lotion. The skin lotion may include, for example, lotions, gels, sunscreens, or any combination thereof.

The refillable lotion housing 2, and in particular the cavity (not shown) of the refillable lotion housing, is sized to receive a predetermined volume of lotion, such as for example 100 ml. The cavity is sized to receive a volume of lotion intended to be used within a single day. The refillable skin lotion dispenser of the present invention is therefore more transportable (i.e. smaller and lighter) than conventional dispensers which contain far larger quantities of lotion.

The first end 6 of the housing 2 provides a threaded portion for complementary threaded engagement with a threaded bore provided on a first end 8 of the collar 4.

The collar 4 comprises a dispensing valve 10 configured to dispense lotion therethrough under gravity. In the illustrated embodiment; the dispensing valve 10 is roller ball 12 in communication with a part-spherical roller ball capture seat allowing for rotation of the ball 12, relative to the seat, to dispense lotion under gravity from the housing 2 onto the skin of a user.

The collar 4 further comprises an annular mounting portion 14 extending around the periphery 16 of the collar 4. In the Figures, it can be seen that the annular mounting portion 14 provides a recess.

The collar 4 further comprises an annular sponge 20 permanently secured, by hot adhesive 18, to the collar 4. The sponge 20 is configured to surround the dispensing valve 10 so as to be operative to spread dispensed lotion over an area of skin.

The annular sponge 20 comprises a first end 22 which is permanently secured by glue 18 within the recess of the annular mounting portion 14 of the collar 4, and an opposed second end 24 defining an application surface 26. The annular sponge 20 comprises inner and outer side portions 28*a,b* extending between the first and second ends 22, 24 of the sponge 20. An opening 30 is defined by the inner side portion 28*a*. The dispensing valve 10 is located, substantially centrally, within this opening 28*a*. The annular sponge 20 extends around the entire periphery of the dispensing valve 10.

The height of the sponge 20 (as measured from the point of attachment of the first end 22 to the collar 4) is equal to or slightly less than the height at which the roller ball 12 extends from the collar 4.

It can be seen that the roller ball 12 comprises a contact point 32 configured in use to be in contact with the skin of a user. The application surface 26 of the annular sponge 14 can be seen to define a plane which is aligned with or passes through the contact point 32 of the roller ball 12.

The refillable lotion dispenser 1 further comprises a valve closure cap 34 configured to be releasably mounted on the collar 14. The closure cap 34 may provide a push fit engagement feature for releasably engaging a complementary feature on the collar 14. In one embodiment, the closure cap 34 may comprise a threaded portion for threaded engagement with a complementary feature on the collar 14.

The housing 2 has a second opposed end 36 which is ergonomically shaped to be grasped and held by a single hand of a user during application of the lotion.

In use, the user removes the collar 4 from the housing 2 by unthreading the threaded portions. The user can then insert the required amount of lotion into the internal cavity (not shown) of the housing 2. The user then re-engages the collar 4 and the housing 2, preferably by threaded engagement of the threaded portions.

The user then removes valve closure cap 34, preferably by pulling, from engagement with the collar 14 and inverts the housing 2 such that the application surface 26 of the annular sponge 20 and the roller ball 10 of the dispensing valve 10 contact the skin of the user. As the user moves the dispenser 1 along the surface of the skin, frictional forces cause rotation of the roller ball 10 causing the lotion to be dispensed under gravity from the internal cavity, onto the roller ball and in turn onto the skin of the user. The annular sponge 20, and in particular the application surface 26, contacts the deposited lotion and with the movement of the dispenser 1 rubs the lotion into the skin of the user in a smooth manner ensuring that all parts of the skin have been covered evenly with the lotion.

The permanent engagement between the sponge 20 and the collar 14 is stronger than the repeated frictional forces applied during use of the dispenser 1. Furthermore, the sponge, collar and adhesive are resistant to breakdown as a result of contact with the lotion, or lotion components, within the dispenser 1, therefore ensuring the dispenser 1 has a long lifespan and can be reused for many applications of lotion without breakage.

The invention claimed is:

1. A refillable skin lotion dispenser comprising:

a refillable lotion housing comprising (i) a collar and a (ii) second opposed end, wherein the second opposed end is shaped to be received in a user's hand, wherein the collar includes a (i) threaded end portion and (ii) a collar opposite end that comprises a dispensing valve, the threaded end portion comprising threads for threaded engagement with the second opposed end, wherein a circumference of a point at which the threads of the threaded end portion are engaged with the second opposed end, is greater than a circumference of the collar opposite end and greater than a distal end of the second opposed end;

the dispensing valve configured to dispense lotion therethrough under gravity; and an annular sponge disposed on the second opposed end and permanently secured to the collar and configured to surround the dispensing valve so as to be operative to spread dispensed lotion over an area of skin.

2. A refillable skin lotion dispenser as claimed in claim 1, in which the annular sponge comprises a first end configured to be permanently secured to the collar and an opposed second end defining an application surface, and side portions extending therebetween defining an opening within which the dispensing valve is located.

3. A refillable skin lotion dispenser as claimed in claim 1, in which the collar comprises a mounting portion for permanent engagement to the annular sponge.

4. A refillable skin lotion dispenser as claimed in claim 1, in which the annular sponge is permanently secured to the collar by adhesive.

5. A refillable skin lotion dispenser as claimed in claim 1, in which the annular sponge extends around a periphery of the dispensing valve.

6. A refillable skin lotion dispenser as claimed in claim 1, in which the dispensing valve is a roller ball in communication with a part-spherical roller ball capture seat allowing for rotation of the ball to dispense lotion under gravity from the housing onto the skin of a user.

7. A refillable skin lotion dispenser as claimed in claim 6, in which the roller ball comprises a contact point configured in use to be in contact with the skin of a user, and in which the annular sponge provides an annular application surface defining a plane which is aligned with or passes through the contact point of the roller ball.

8. The refillable skin lotion dispenser of claim 6 wherein the roller ball comprises a diameter that greater than a thickness of the annular sponge.

9. The refillable lotion dispenser as claimed in claim 1, in which the housing defines an internal cavity configured to receive lotion therein.

10. The refillable lotion dispenser as claimed in claim 1, further comprising a valve closure cap configured to be releasably mounted on the collar.

11. The refillable lotion dispenser as claimed in claim 1, wherein the second opposed end is ergonomically shaped to be held by a single hand of a user during application of the lotion.

12. The refillable skin lotion dispenser of claim 1, wherein the second opposed end is shaped to be received within, and to contact, the palm of a hand of a user such that the fingers extend across the second opposed end and are received within a recess located between the collar and the distal end of the second opposed end.

13. A method for manufacturing a refillable skin lotion dispenser as claimed in claim 1, in which the method comprises:

permanently securing the annular sponge to the collar comprising a dispensing valve, such that the annular sponge surrounds the dispensing valve; and releasably mounting the collar comprising a dispensing valve on a first end of the second opposed end.

14. A refillable skin lotion dispenser comprising:

a refillable lotion housing comprising (i) a collar and a (ii) second opposed end, wherein the second opposed end is shaped to be received in a user's hand, wherein the collar includes a (i) threaded end portion and (ii) a collar opposite end that comprises a dispensing valve, the threaded end portion comprising threads for threaded engagement with the second opposed end, wherein a circumference of a point at which the threads of the threaded end portion are engaged with the second opposed end, is greater than a circumference of the collar opposite end and greater than a distal end of the second opposed end, wherein the housing increases in diameter from the collar opposite end to the second opposed end, and wherein the second opposed end increases in diameter from a recess to the collar wherein the recess is located between the collar and the distal end of the second opposed end;

the dispensing valve configured to dispense lotion therethrough under gravity; and an annular sponge disposed on the second opposed end and permanently secured to the collar and configured to surround the dispensing valve so as to be operative to spread dispensed lotion over an area of skin.

15. The refillable skin lotion dispenser of claim 14, wherein second opposed end is shaped to be received within, and to contact, the palm of a hand of a user such that the fingers extend across the second opposed end and are received within the recess located between the collar and the distal end of the second opposed end.

16. The refillable skin lotion dispenser of claim 14 wherein the dispensing valve is a roller ball in communication with a part-spherical roller ball capture seat allowing for rotation of the ball to dispense lotion under gravity from the housing onto the skin of a user and wherein the roller ball comprises a diameter that greater than a thickness of the annular sponge.

* * * * *